United States Patent [19]

Clarke

[11] Patent Number: 4,745,643

[45] Date of Patent: May 24, 1988

[54] MODULAR SLEEPING UNIT FOR SHIP CREW OR THE LIKE

[75] Inventor: Richard E. Clarke, King County, Wash.

[73] Assignee: Amtech Corporation, Yelm, Wash.

[21] Appl. No.: 757,275

[22] Filed: Jul. 18, 1985

[51] Int. Cl.[4] ..... A47C 19/20; B63B 29/10

[52] U.S. Cl. ..... 5/9 R; 5/2 R; 5/8; 5/308; 52/36; 114/192

[58] Field of Search ..... 5/8 R, 9 R, 9 B, 2 R, 5/1, 308, 58; 114/188, 189, 192; 244/118.6; 52/36, 27

[56] References Cited

U.S. PATENT DOCUMENTS

| | | | |
|---|---|---|---|
| 80,184 | 7/1868 | Judson | 5/9 R |
| 167,217 | 8/1875 | Brown | 114/192 |
| 236,514 | 1/1881 | Schrader | 114/192 |
| 431,385 | 7/1890 | Munson | 114/192 |
| 1,180,034 | 4/1916 | Harman | 114/192 |
| 2,374,641 | 5/1945 | Badin | 5/308 |
| 3,722,011 | 3/1973 | Miller | 5/2 R |
| 3,811,138 | 5/1974 | Del Missier | 5/9 R |
| 3,950,796 | 4/1976 | Hollingsworth | 5/9 R |
| 4,071,210 | 1/1978 | Mutke | 5/9 R |
| 4,110,854 | 9/1978 | Sjolie | 5/2 R |
| 4,259,755 | 4/1981 | Hollander | 5/308 |
| 4,395,785 | 8/1983 | Huh | 5/2 R |
| 4,440,439 | 4/1984 | Szabo | 5/9 B |
| 4,505,078 | 3/1985 | Huh | 5/2 R |
| 4,589,612 | 5/1986 | Halim | 5/9 R |
| 4,594,817 | 6/1986 | McLaren et al. | 5/2 R |

FOREIGN PATENT DOCUMENTS

| | | | |
|---|---|---|---|
| 14129 | of 1929 | Australia | 5/58 |
| 345996 | 11/1904 | France | 114/192 |
| 734647 | 8/1932 | France | 5/58 |
| 49106 | 3/1931 | Norway | 5/58 |
| 3112 | of 1871 | United Kingdom | 114/192 |
| 10184 | of 1890 | United Kingdom | 114/189 |
| 11551 | of 1891 | United Kingdom | 5/9 R |
| 17504 | of 1911 | United Kingdom | 5/58 |
| 216201 | 5/1924 | United Kingdom | 5/9 R |
| 451482 | 8/1936 | United Kingdom | 5/308 |
| 2044085 | 10/1980 | United Kingdom | 5/9 B |

*Primary Examiner*—Alexander Grosz
*Attorney, Agent, or Firm*—Seed and Berry

[57] ABSTRACT

A modular sleeping unit having individual, stackable, unitary berths providing increased comfort for crew members. The berths are constructed from reinforced plastics or other materials and are dimensioned to fit through typical ship access openings. The berths can be provided with drawer units or integral storage lockers. Lighting and ventilation can be controlled from each berth.

6 Claims, 7 Drawing Sheets

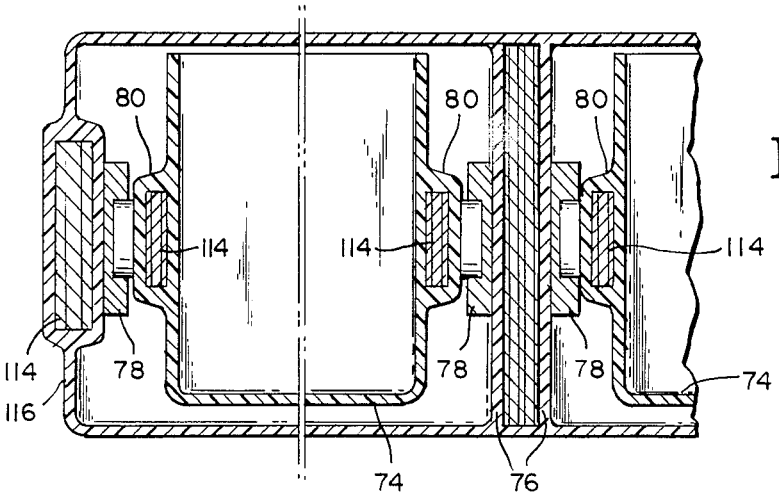
FIG. 4
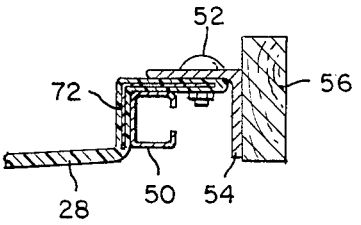
FIG. 5
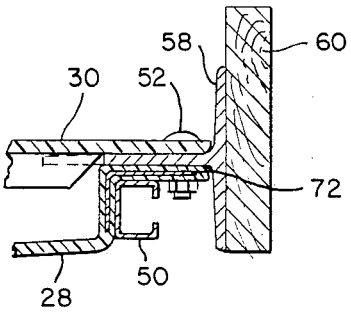
FIG. 6
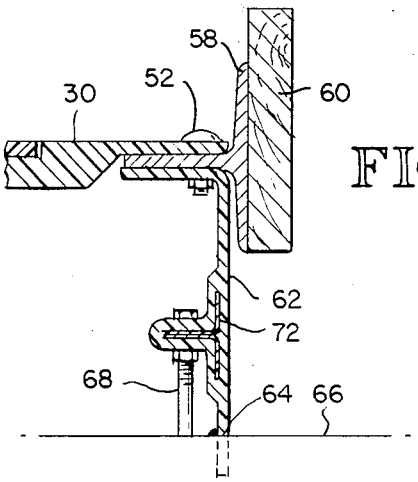
FIG. 7
FIG. 8
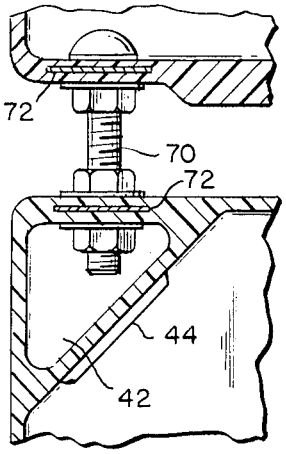

MODULAR SLEEPING UNIT FOR SHIP CREW OR THE LIKE

TECHNICAL FIELD

The invention relates to stackable bunks for a ship's crew. More specifically, the invention relates to a modular sleeping unit having individual, stackable, unitary berths providing increased comfort for crew members.

BACKGROUND OF THE ART

Presently, crew members aboard ship often sleep in bunks one above the other. Typically, these bunks are constructed from metal pieces which are bolted together. These bunks provide little privacy or comfort for occupants, are inherently difficult to install, and often rattle with vibrations in the ship. These bunks are usually not enclosed for each individual and do not provide air circulation or lighting controllable by each occupant. Furthermore, these bunks are often installed on uneven or curved surfaces in the ship requiring modification of the bunks to provide level sleeping surfaces. These bunks are not dimensioned to fit through typical ship access openings when assembled and therefore must be brought aboard disassembled, only to be reassembled in the bunk room or cabin. The springs and supporting straps catch dust and are difficult to clean.

DISCLOSURE OF THE INVENTION

Therefore, it is an object of the invention to provide quiet, private, and aesthetically appealing berths for crew members.

It is another object of the invention to provide berths which can be easily installed and which require little maintenance.

It is another object of the invention to provide berths having individual air circulation and lighting.

It is another object of the invention to provide berths which are adjustable to compensate for uneven or irregular deck surfaces.

It is another object of the invention to efficiently utilize the space previously occupied by typical bunks.

These and other objects and advantages of the invention will become apparent as the invention is described more fully below. The objects are obtained by providing a modular sleeping unit or assembly having individual berths of unitary construction which are stackable to fit one above the other and which are each dimensioned to fit through typical ship access openings. Each berth can be provided with integral air conditioning ducts, lighting, and curtains.

In one embodiment, each berth is a pan berth and has a top, a bottom pan adapted to accept a mattress, a back, a ventilation wall, and two ends. These parts define an interior with an entry-egress opening and include a ventilation wall that is angled from the top and the back so that the interior of the berth is smooth and without any sharp corners or protrusions. The pan berth is provided with means for joining the pan berth with other berths and for leveling the berths. The pan berth is sized to fit through typical ship access openings having perimeter dimensions of approximately 26 inches by 66 inches, with 8-inch radius corners.

A drawer unit, adapted to fit above or below a pan berth, can be provided to provide each berth with an individual drawer for storing clothing and other items.

In a second embodiment, the pan berth is modified to form a locker berth which has a hinged bottom panel and locker section therebelow. The hinged bottom panel is preferably formed to accept a mattress. A bottom panel prop bar is preferably provided to hold the hinged bottom panel in an open position.

The pan berths, locker berths, and drawer units can be stacked in a variety of combinations, as desired. The leveling and joining means of each unit are adapted to engage with one another.

When the berths are stacked and combined in the above fashion, or when either type of berth is used individually, a base unit can be provided to support the entire sleeping unit. The base unit can connect to the joining means of either berth and has a skirt which can be trimmed flush to an irregular deck surface. The base unit is adjustable so that the sleeping unit can be leveled. The base unit can also be secured to the deck surface, thus securing the entire modular crew sleeping unit.

BRIEF DESCRIPTION OF THE DRAWINGS

FIG. 4 is a partial, sectional front elevational view of a drawer unit taken through line 4–4 of FIG. 3.

FIG. 5 is an enlarged sectional side elevational view of circled area 5 of FIG. 2.

FIG. 6 is an enlarged sectional side elevational view of circled area 6 of FIG. 2.

FIG. 7 is an enlarged sectional side elevational view of circled area 7 of FIG. 2.

FIG. 8 is an enlarged sectional side elevational view of circled area 8 of FIG. 2, illustrating the joining means for joining and leveling the berths.

BEST MODE FOR CARRYING OUT THE INVENTION

Figure 1:
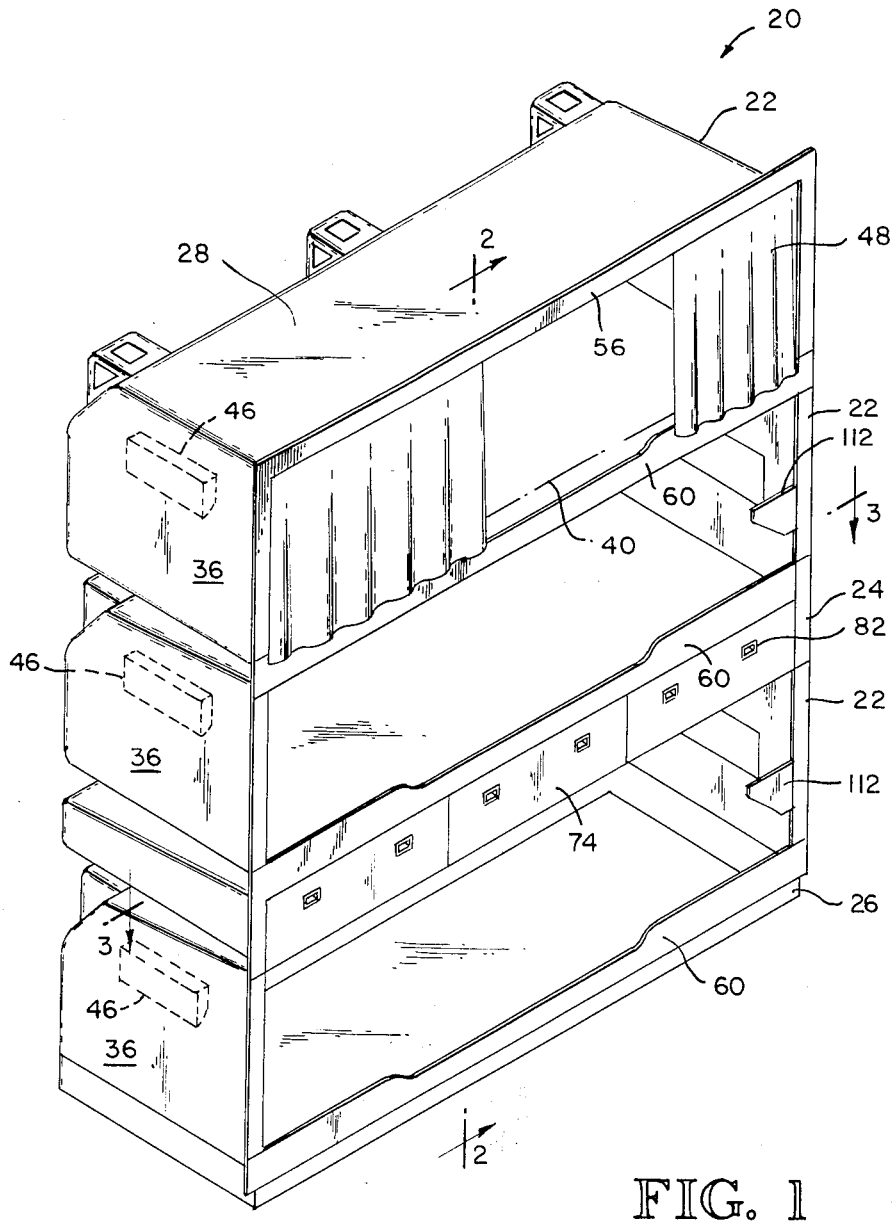
FIG. 1 is an isometric view of three pan berth units in combination with a drawer unit and a base unit.

In FIG. 1, a modular crew sleeping unit in accordance with the present invention is generally indicated at reference numeral 20. In this embodiment, the sleeping unit has three pan berths 22, a drawer unit 24, and a base unit 26.

Figure 2:
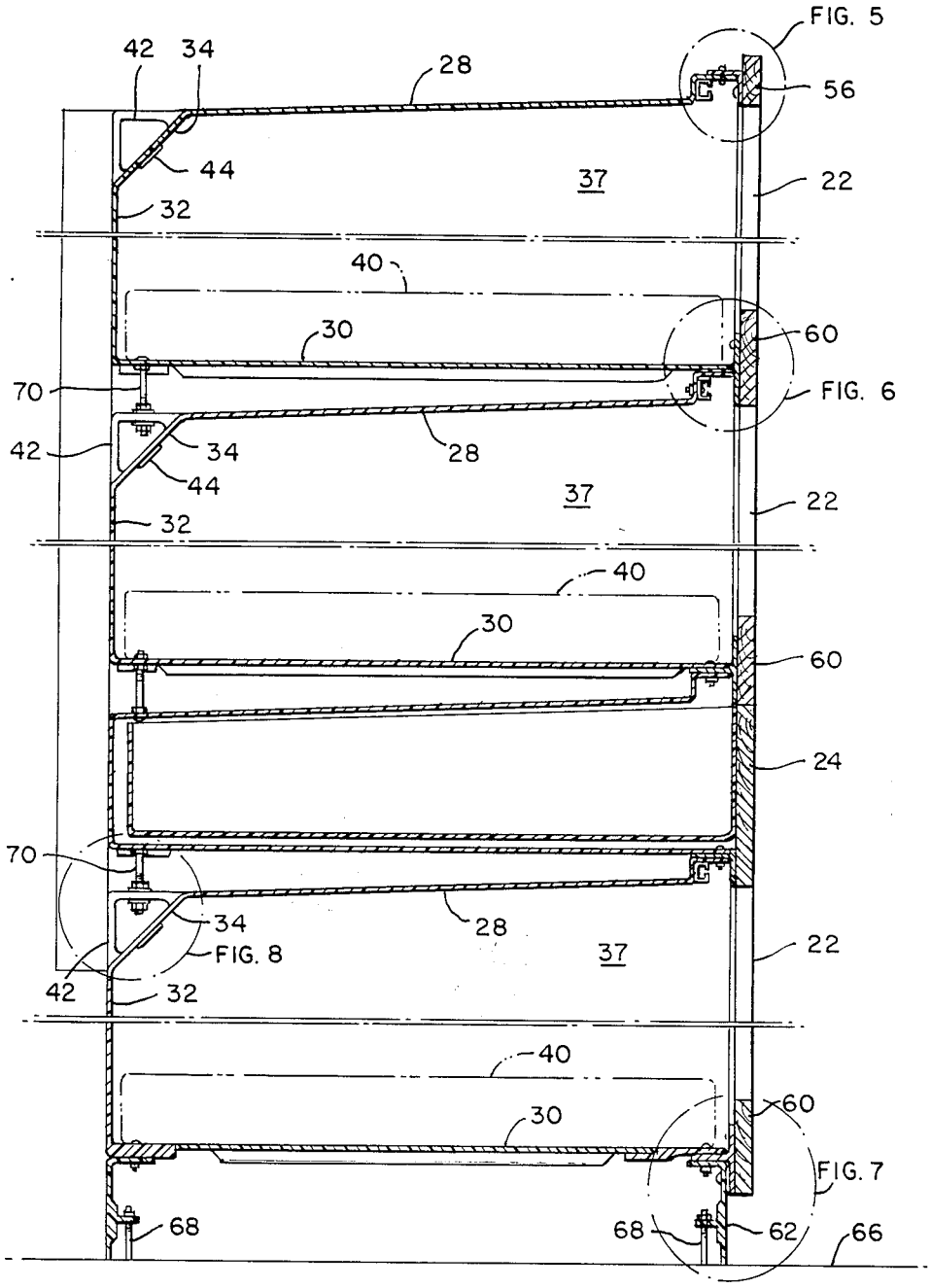
FIG. 2 is a sectional side elevational view of the units of FIG. 1, taken through line 2—2 of FIG. 1.

As shown in FIGS. 1 and 2, each pan berth 22 has a top 28, a bottom pan 30, a back 32, a ventilation wall 34, and two ends 36 and 37. The bottom pan is adapted to accept a typical mattress 40 shown in phantom lines. The top, bottom pan, back, ends, and ventilation wall are preferably continuous to form a unitary pan berth. Thus vibration of the ship will not cause squeaks and rattles to occur. Furthermore, this unitary construction provides a private and relatively soundproof environment for each crew member. The ventilation wall 34 is disposed from the top and back at an angle of approximately 45° so that the interior surface of the pan berth provides a smooth interior with no sharp angles or projections. It is preferred to form the pan berths from reinforced plastics to provide a relatively rigid and lightweight structure.

An air conditioning duct 42 is molded onto the outer surface of the ventilation wall to provide an airflow path for each berth having a substantially triangular cross section. The ventilation wall can be pierced to accept vents 44 so that each occupant can control the airflow to the interior of each berth individually. A reading lamp or light 46 is provided for each berth on either end 36, 38. A curtain 48 is preferably provided for each berth to conceal the entry-egress opening defined by the top, bottom, back, ends and ventilation wall of the berth. As shown in FIGS. 2 and 5, a curtain channel 50 is provided so that the curtain 48 is slidably engaged with the top 28. A connector 52 and bracket 54 can be used to attach a facing 56 to provide an aesthetically appealing exterior face to the unit 20. As shown in FIGS. 2 and 6, the bottom pan 30 of the uppermost berth is joined to the top 28 of the intermediate berth by a larger bracket 58 which supports a second facing 60.

As seen in FIGS. 2 and 7, a base unit 26 is provided to support the entire modular crew sleeping unit 20. The base unit has a skirt 62 which can be trimmed flush to an irregular deck surface 66 to provide a flush junction between the sleeping unit and the deck surface. The skirt is preferably provided with adjusters 68 to level the sleeping unit. The adjusters have sufficient length to allow the unit to be leveled on sloping or curved deck surfaces which typically occur at various places on board a ship where the units may be used.

As shown in FIGS. 2 and 8, joining bolts 70 are provided to secure the berth units to one another and are also capable of adjusting the relative distance between berths to level the berths. Metal stiffening elements 72 are molded into the berths to provide extra strength and rigidity to the points where various connectors and fittings attach to the berths.

Figure 3:
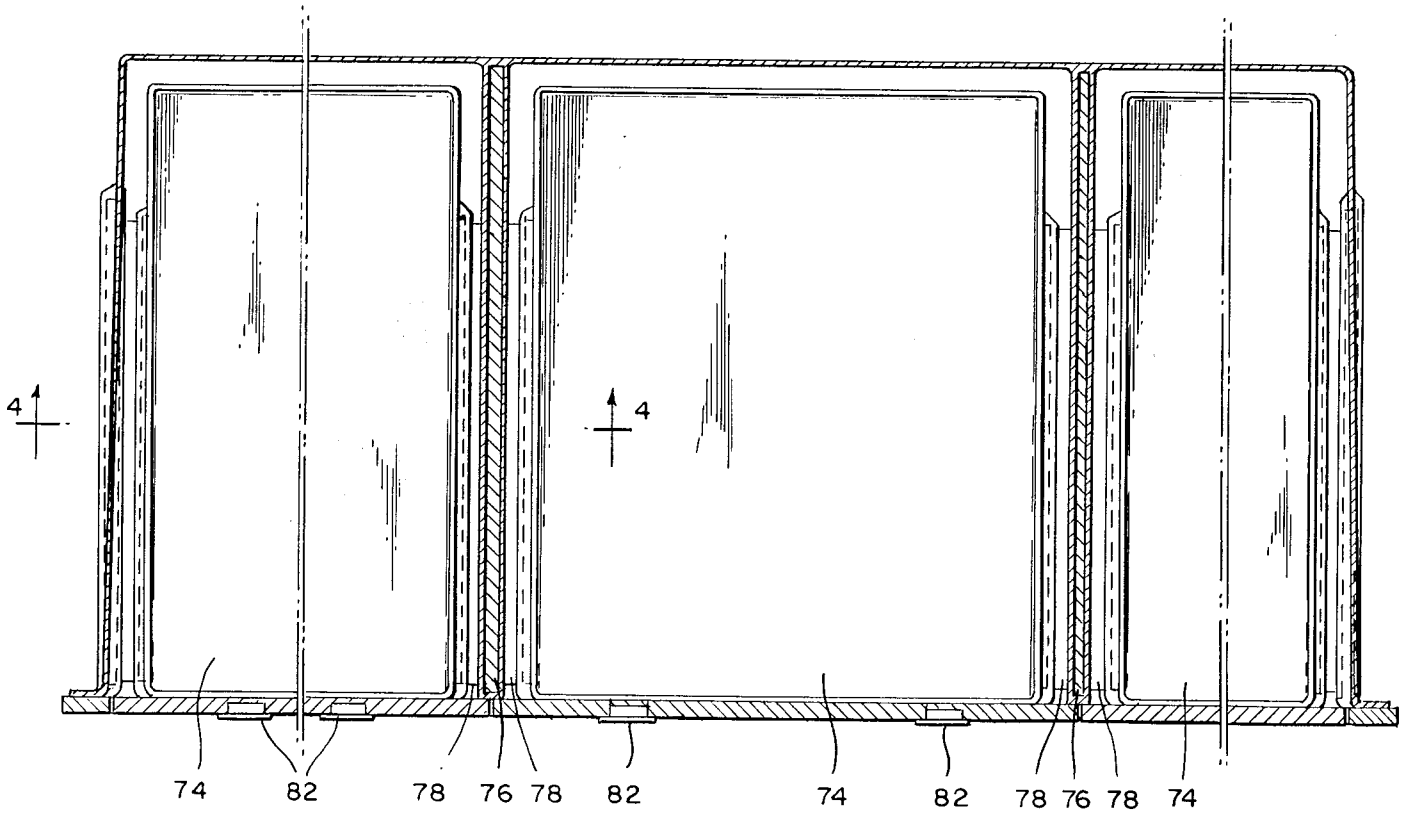
FIG. 3 is a cross-sectional, top plan view of the drawer unit of FIG. 1 taken through line 3—3 of FIG. 1.

The drawer unit 24 also has means for joining with and connecting to the pan berths 22. As shown in FIGS. 3 and 4, the drawer unit can be provided with drawers 74 for each berth. The drawers are separated by support walls 76, which add rigidity to the drawer unit. The support walls are provided with drawer channels 78, Which are adapted to engage with conventional sliding mechanisms on the sides 80 of the drawers. Each drawer can be provided with handles 82.

When the pan berths 22 and drawer units 24 are constructed from reinforced plastics, as is preferred, wooden stiffening elements 114 can be moulded into the bottom pan 30 of the pan berth as shown in FIG. 4 and also into the sides 116 of the drawer unit 24 and the sides 80 of the drawer 74. A preferred material for the wooden stiffening elements 114 is balsa wood although other suitable materials can be substituted.

Figure 9:
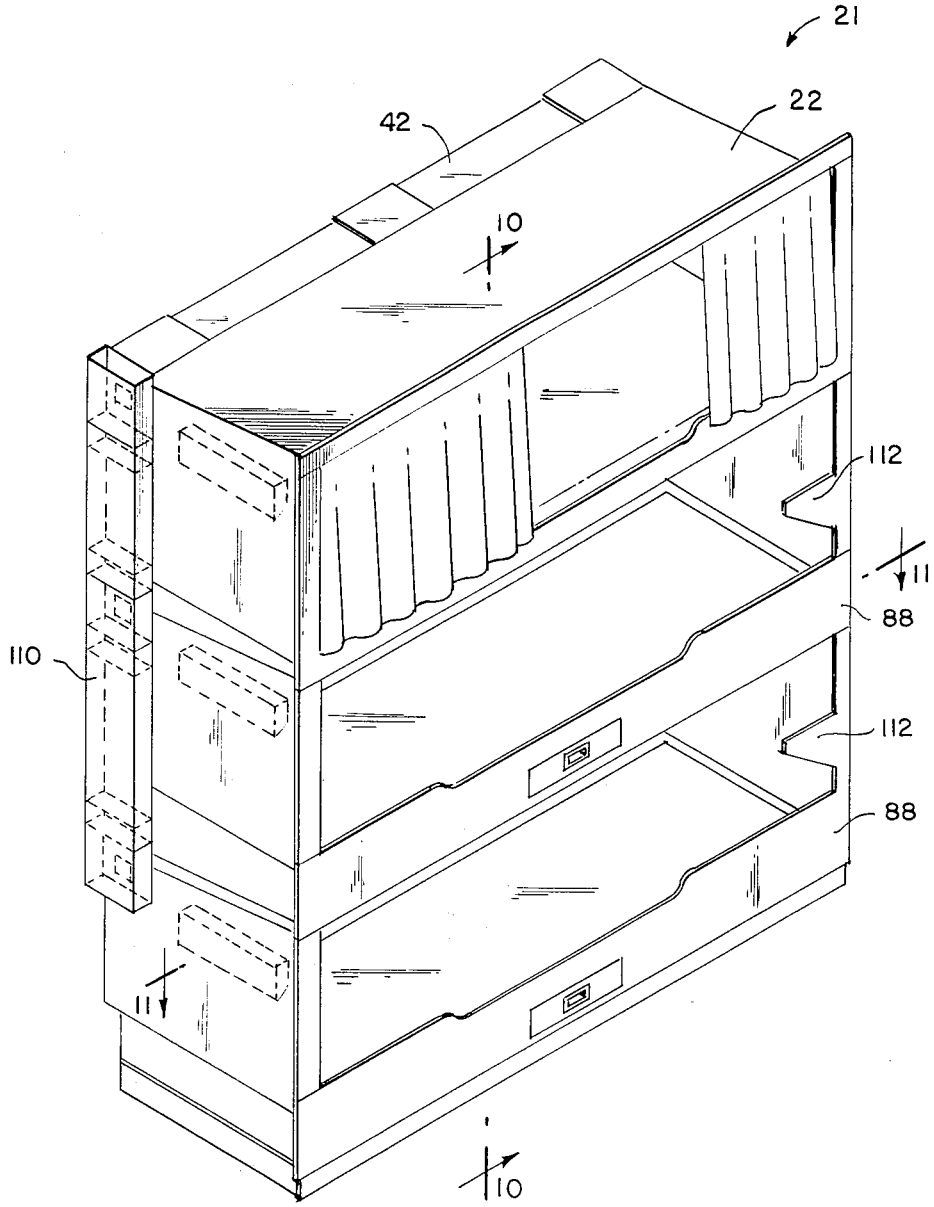
FIG. 9 is an isometric view of a second embodiment of the modular crew sleeping unit having one pan berth and two locker berths stacked together on a base unit.
Figure 10:
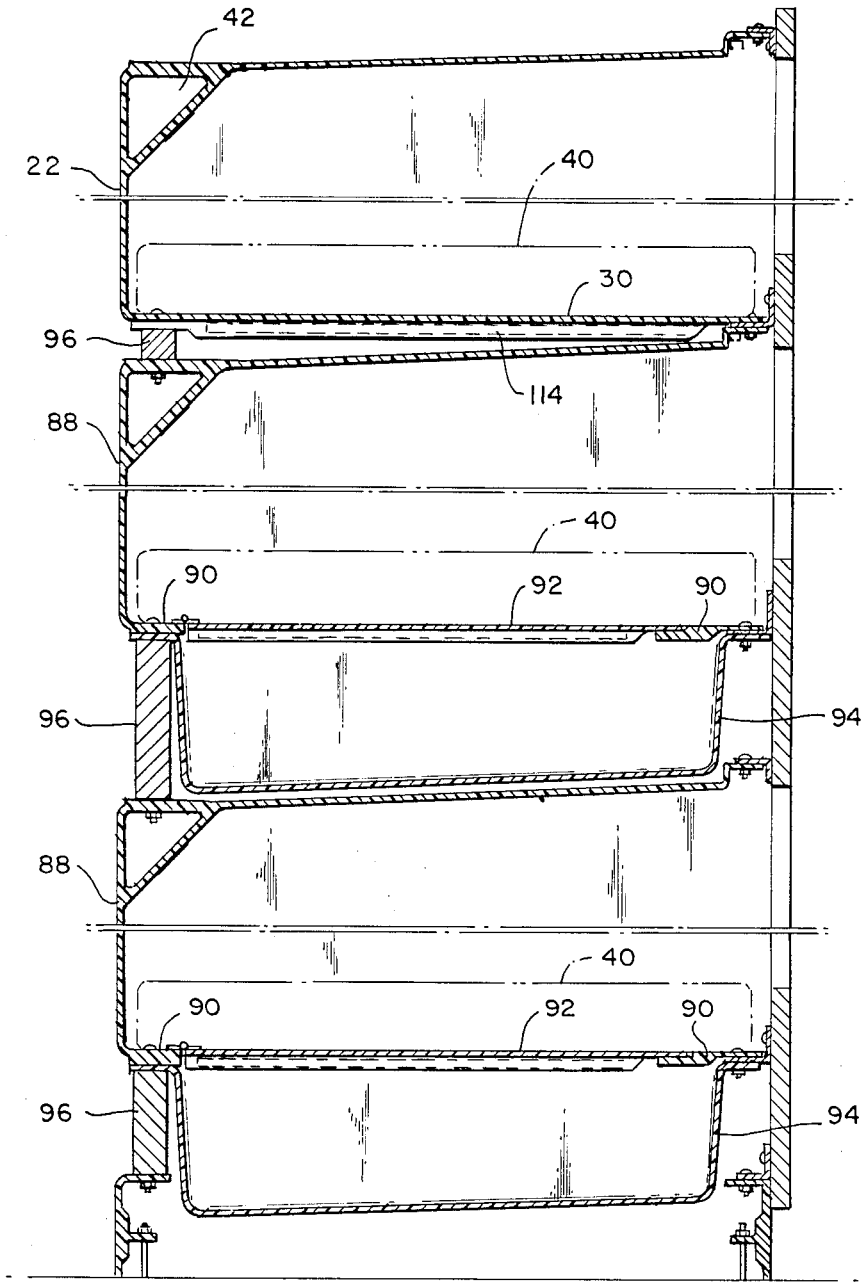
FIG. 10 is a sectional side elevation of the modular crew sleeping unit of FIG. 9, taken through line 10—10 of FIG. 9.

A second embodiment of the modular crew sleeping unit 21 is shown in FIGS. 9 and 10. In these embodiments, the unit has an uppermost pan berth 22 and intermediate and lowermost locker berths 88. The locker berths are similar to the pan berths in construction except that each locker berth has a bottom frame 90 which surrounds a hinged bottom panel 92 (see FIG. 10). It is preferred to mold a honeycomb structure into the hinged bottom panel to make the structure strong, yet light weight. The hinged bottom panel opens to reveal a locker section 94 which is connected to the bottom frame. The locker section provides a large individual storage area for each locker berth. The bottom frame and the hinged bottom panel are sized and adapted to accept a mattress 40, as is the bottom pan 30 of the pan berth 22. Supports 96 are provided to separate and support the individual berths.

Figure 11:
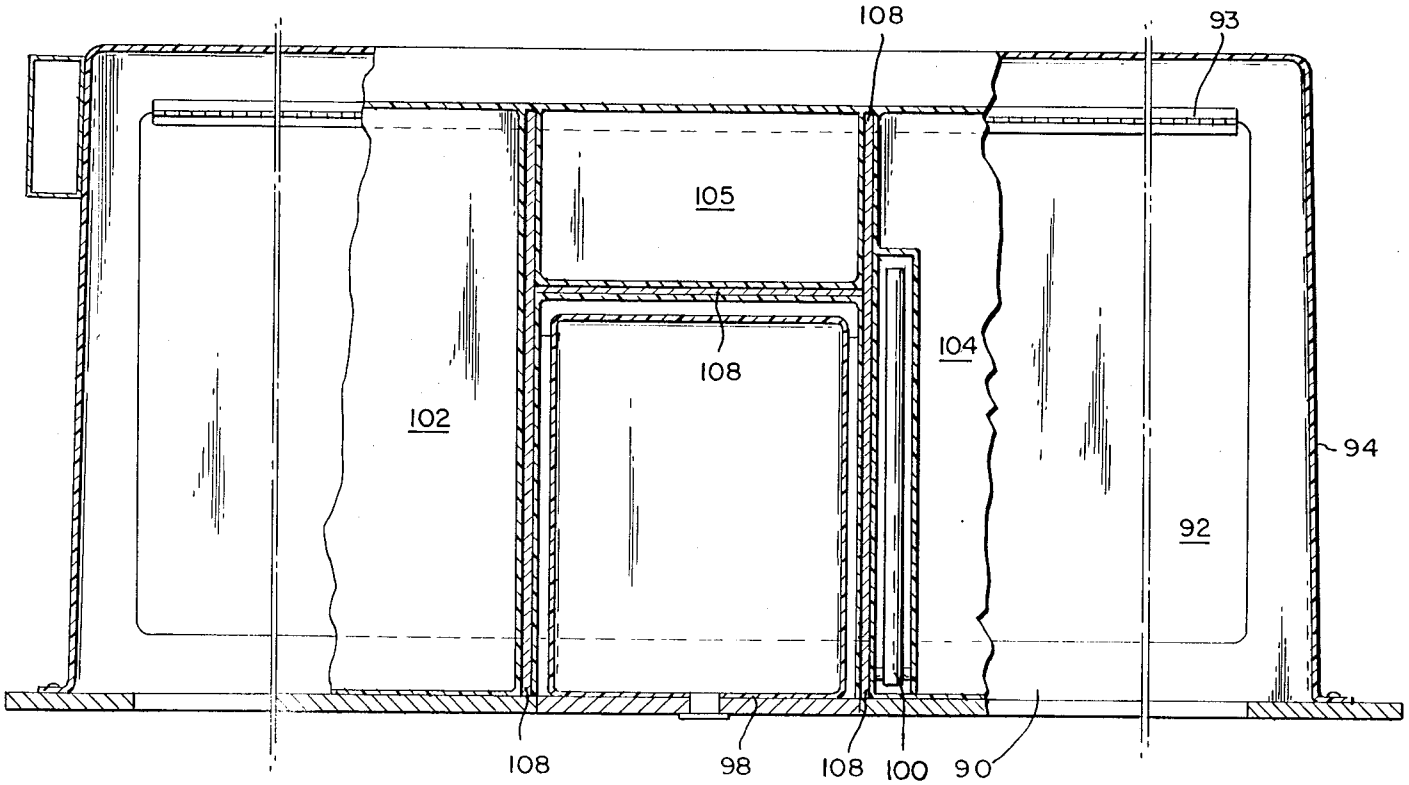
FIG. 11 is a partial, sectional, top plan view of a locker section taken through line 11—11 of FIG. 9.

In the embodiments shown in FIG. 11, each locker section 94 is provided with a small drawer 98 to hold various frequently used items (not shown) and a relatively large left and right storage areas 102, 104 and a smaller rear storage area 105. The left, right and rear storage areas are accessed by lifting the hinged bottom panel. A bottom panel prop bar 100 is provided for holding the bottom panel open. The storage areas are defined by dividers 108, which add rigidity to the locker section and which add support to the hinged bottom panel 92.

As shown in FIG. 9, in this embodiment the air conditioning ducts 42 are longitudinally coextensive with the ventilation wall of the berths and are interconnected by external ducts 110.

Steps 112 can be provided near either end 36, 38 of the locker berths 88 and pan berths 22 to provide assistance in entering the uppermost berth.

In the preferred embodiments designed for use aboard existing naval vessels, it is preferred that the individual berths be sized to fit through existing access openings. Thus, for this purpose only, the maximum length of any berth cannot exceed approximately 81 5/16 inches, the maximum height of any berth cannot exceed approximately 22¾ inches, and the maximum depth of any berth cannot exceed approximately 28 inches. Typical ship access openings have perimeter dimensions of approximately 26 inches by 66 inches with 8-inch radius corners.

Other variations and embodiments of the invention herein disclosed are also contemplated. For example, any variety of combinations of locker berths 88 or pan berths 22 with or without drawer units 24 can be assembled. Substitutions of other suitable materials in place of reinforced plastics are permissible. Thus, the invention is not to be limited by the above description, but is to be determined in scope by the claims which follow.

I claim:

1. A berth system adapted for easy installation in a ship, comprising a plurality of modular sleeping units, each comprising a unitary berth having integral top, bottom pan, back wall and two end portions defining an interior with an entry-egress opening, wherein the bottom pan is sized to accept a mattress wherein the bottom pan forms a bottom frame portion having a hinged bottom panel contained therein and including a locker section connected to the bottom frame portion and disposed beneath the hinged bottom panel wherein the hinged bottom panel can be opened to reveal the locker section, the locker section having a drawer and a bottom panel prop bar to hold the hinged bottom panel in an open position, wherein the drawer is smaller in area than the locker section and wherein the locker section includes dividers which provide support for the hinged bottom panel and which define right, left, and rear storage area and a drawer receptacle separate therefrom, whereby access to the storage areas is only available through the hinged bottom panel, said units mounted on top of each other, the lowermost one including adjuster means to level the berth system relative to a supporting surface.

2. The system of claim 1, including means for ventilating the unit.

3. The system of claim 2 wherein the ventilating means comprises an integral ventilation duct defined by the top, back wall and end portions including perforations on the ventilation duct which communicate with an air conditioning duct.

4. The system of claim 1 wherein the berth has a maximum exterior length no greater than approximately 81 5/16 inches, a maximum height which is no greater than approximately 22¾ inches, and a maximum depth which is no greater than approximately 28 inches so that each individual pan berth can fit through a typical ship access opening having perimeter dimensions of approximately 26 inches by 66 inches with 8-inch radius corners.

5. The system of claim 1, including means for slidably attaching a curtain to selectively conceal and expose the entry-egress opening and including a light on either end portion.

6. The system of claim 1, further including support bars adapted to space a bottom sleeping unit from an upper sleeping unit.

* * * * *